US005878511A

United States Patent [19]

Krajcir

[11] Patent Number: 5,878,511

[45] Date of Patent: Mar. 9, 1999

[54] TOE AND METATARSAL PROTECTORS FOR SAFETY FOOTWEAR

[76] Inventor: Dezi Krajcir, 330 Ramsay Drive, Dunnville, Ontario, Canada, N1A 2X1

[21] Appl. No.: 933,883

[22] Filed: Sep. 19, 1997

[51] Int. Cl.[6] ..... A43C 13/14

[52] U.S. Cl. ..... 36/77 R; 36/72 R

[58] Field of Search ..... 36/77 R, 72 R, 36/96

[56] References Cited

U.S. PATENT DOCUMENTS

| | | |
|---|---|---|
| 3,561,142 | 2/1971 | Streit, Sr. et al. . |
| 4,342,159 | 8/1982 | Edwards . |
| 4,870,762 | 10/1989 | Lee . |
| 5,581,912 | 12/1996 | Adams . |

FOREIGN PATENT DOCUMENTS

| | | |
|---|---|---|
| 1809766 | 6/1970 | Germany . |
| 2935959 | 4/1981 | Germany . |

*Primary Examiner*—Ted Kavanaugh
*Attorney, Agent, or Firm*—McConnell and Fox

[57] ABSTRACT

A toe protector, or a metatarsal protector, or a combined toe and metatarsal protector for safety footwear are molded from plastics material either integrally or separately and then attached to one another for storage and incorporation into the finished footwear. Each part of the respective protector comprises a generally U-shaped body provided at the central part of its top outer surface with two mutually facing, spaced surfaces extending outward therefrom and bounding between them a central part of the top portion. A force receiving plate overlies the respective central part with its lower surface spaced from the central part, is of concave shape toward the central part, and has two spaced edges engageable with the two surfaces. In an integral structure the adjacent surfaces and edges are constituted by corresponding integral junctions. Crushing and impact forces applied to the plate member press it toward the central part with conversion of such crushing and impact forces to corresponding butting forces distributed along the surfaces and compression forces in the sides of the U. The force receiving plate member may comprise a thin molded sheet of plastics material or a thin formed sheet of metal. Each protector body part and force receiving plate member may be divided along its length by transversely extending slots to increase its longitudinal flexibility so as to accommodate the action of walking.

37 Claims, 4 Drawing Sheets

TOE AND METATARSAL PROTECTORS FOR SAFETY FOOTWEAR

FIELD OF THE INVENTION

This invention is concerned with improvements in or relating to toe and/or metatarsal protectors as used in safety footwear, namely boots and shoes that are worn in locations where there is danger of impact or compression forces being applied to and injuring the feet of the wearer.

BACKGROUND OF THE INVENTION

Many industries now require that workers wear safety footwear to protect their feet against injury caused, for example, by blows from above by falling objects, or crushing such as may be caused by a vehicle wheel rolling over the foot. Almost all safety footwear currently available comprise a toe protector, usually a steel box toe (sometimes called a toe box) providing a protective arch above the toes through which any impact or crushing force applied to its top surface is transmitted to the insole on which it rests, and through the insole to the outsole and the ground. It is a requirement for official certification (details of which are given below) that the box toe shall be incorporated into the footwear during construction and shall be an integral part of the footwear. Also, provision is now commonly made to protect the metatarsus, namely the five long bones of the instep extending from the toes to the remainder of the bones of the foot. Many of the prior proposals for metatarsal protection comprise a guard that is applied to the exterior of the boot or shoe, but increasingly the protector is incorporated into the footwear, it also being arranged to transmit any forces applied to it through the insole and outsole to the ground.

The Occupational Health & Safety Association (OHSA) specifies test and performance standards that have been established by American National Standards Inc. (ANSI) which safety footwear must pass if they are to be certified by them. The Canadian Standards Association (CSA) have adopted equivalent standards. The test procedure for impact force resistance involves dropping a standard weight on to the toe portion of a specimen boot (size 9D for men's footwear and 8B for women's footwear) at a point 2.5 cm (1.0 in) from the outside tip of the toe under conditions such that it exerts a nominal impact force of specified value at a specified impact velocity. Three values of force are used, namely 101.7 Joules (75 foot pounds), 67.8 Joules (50 foot pounds), and 40.7 Joules (35 foot pounds) and footwear meeting one of these standards is certified with the designation I/75, I/50 or I/35 respectively. In the crushing force test procedure the toe protector is subjected to a crushing force of 1,134 Kg (2,500 lbs; 11,121 Newtons), or 795 Kg (1,750 lbs; 7,784 Newtons), or 455 Kg (1,000 lbs; 4,448 Newtons), and depending upon the level of force that the footwear withstands it is certified with the designation C/75, C/50 or C/35 respectively. With both tests the boot is not certified if either of these forces depresses the toe portion so that the clearance inside is less than 1.27 cm (0.5 in) for a men's boot and 1.19 cm (0.468 in) for a women's boot.

The equivalent impact force test for a metatarsal protector (there is no compression test) requires the force to be applied at a point 8.9 cm (3.5 in) from the outside tip of the 9D boot toe (8.6 cm or 3.375 in for the 8B boot) and be of nominal value 101.7 Joules (75 foot pounds), or 67.8 Joules (50 foot pounds), or 40.7 Joules (30 foot pounds), the required minimum clearance remaining after the test being 2.5 cm (1.0 in) for the 9D boot and 2.4 cm (0.94 in) for the 8B boot.

Footwear meeting one of these standards is certified with the designation Mt/75, Mt/50 or Mt/35 respectively.

Box toes of plastics materials are available, but they are significantly thicker than the commonly used steel box toe, so that it is more difficult to incorporate them into the boot construction without the resultant boot toe appearing much more bulky, especially in side elevation. Moreover, most safety footwear is manufactured by molding the outsole to the remainder of the boot and the thicker box toe makes it impossible to use existing molds that have employed steel box toes, so that expensive new molds are required for each style of boot. Metatarsal protectors of plastics material, e.g. high density polyethylene or polypropylene (HDPE or HDPP), ABS and various proprietary nylons, are also available and again, if the standards for impact forces are to be met, the protector is such thickness that, even if the more expensive high modulus plastics materials are used, it is difficult to incorporate in safety footwear of standard sizes. The manufacture of both box toes and metatarsal protectors from plastics material has the advantage that even if of complex shape they can be molded in a single relatively inexpensive operation. There is also the possibility that protectors that are lighter in weight can also be produced. Manufacturers of safety footwear face an inherent marketing problem that whether the footwear is supplied by the employer at cost, or with a subsidy, or whether it is purchased directly by the wearer, it is basically a product for which a relatively low purchase price is required by the customer, so that minimization of manufacturing cost is of primary importance.

SUMMARY OF THE INVENTION

It is therefore the principal object of the invention to provide a toe protector, or a metatarsal protector, or a combination toe and metatarsal protector, that can readily be molded from plastics material and meet the test requirements for certification.

It is another object to provide a toe protector, or a metatarsal protector, or a combination toe and metatarsal protector, that can be readily molded relatively inexpensively from plastics material.

It is a further object to provide a toe protector, or a metatarsal protector, or a combination toe and metatarsal protector, molded from plastics material that is able meet the test requirements for certification while being sufficiently thin that it can be incorporated by molding in safety footwear using molds previously employed for steel box toes.

In accordance with the present invention there is provided a toe protector for safety footwear that comprise an upper and a sole joined to one another, the upper and sole each having respective outer and inner surfaces and having respective registering toe regions;

wherein the toe protector comprises a generally U-shaped body molded from plastics material, having a top portion constituting a base of the U and two side portions constituting respective sides of the U;

wherein the toe protector when incorporated into safety footwear is interposed between the upper and sole toe regions, and when so interposed has an outer surface convex toward the inner surface of the upper and an inner surface concave toward the inner surface of the sole;

wherein the toe protector body is provided at its top portion outer surface with two mutually facing, spaced surfaces extending outward from the outer surface toward the inner surface of the upper, the surfaces bounding between them a central part of the top portion outer surface;

wherein the toe protector also comprises a force receiving plate member having respective upper and lower surfaces and overlying the central part of the top portion outer surface with its lower surface spaced from the said central part, the plate member being of concave shape toward the said central part and having two spaced edges engageable respectively with the two surfaces of the protector body;

whereby crushing and impact forces applied to the force receiving plate member are operative to attempt to press the plate member toward the said central part and to forcibly butt its edges against the two cooperating surfaces with conversion of such crushing and impact forces to corresponding butting forces distributed along the surfaces.

Also in accordance with the invention there is provided a metatarsal protector for safety footwear that comprise an upper and a sole joined to one another, the upper and sole each having respective outer and inner surfaces and having respective registering metatarsal regions;

wherein the metatarsal protector comprises a generally U-shaped body molded from plastics material, having a top portion constituting a base of the U and two side portions constituting sides of the U;

wherein the metatarsal protector when incorporated into safety footwear is interposed between the metatarsal regions, and when so interposed has an outer surface convex toward the inner surface of the upper and an inner surface concave toward the inner surface of the sole;

wherein the protector body is provided at its top portion outer surface with two mutually facing spaced surfaces extending outward from the outer surface toward the inner surface of the upper, the side surfaces bounding between them a central part of the top portion outer surface; and wherein the metatarsal protector also comprises a force receiving plate member having respective upper and lower surfaces overlying the said central part of the top portion outer surface with its lower surface spaced from the said central part, the plate member being of concave shape toward the said central part and having two spaced edges engageable respectively with the two surfaces of the protector body;

whereby crushing and impact forces applied to the plate member are operative to attempt to press the plate member toward the said central part and to forcibly butt its edges against the two cooperating surfaces with conversion of such crushing and impact forces to corresponding butting forces distributed along the surfaces.

Further in accordance with the invention there is provided a toe and metatarsal protector that is a combination of the toe and metatarsal protectors of the invention.

DESCRIPTION OF THE DRAWINGS

Toe protectors, metatarsal protectors and combination toe and metatarsal protectors that are particular preferred embodiments of the invention will now be described, by way of example, with reference to the accompanying diagrammatic drawings, wherein.

DESCRIPTION OF THE PREFERRED EMBODIMENTS

Figure 1:
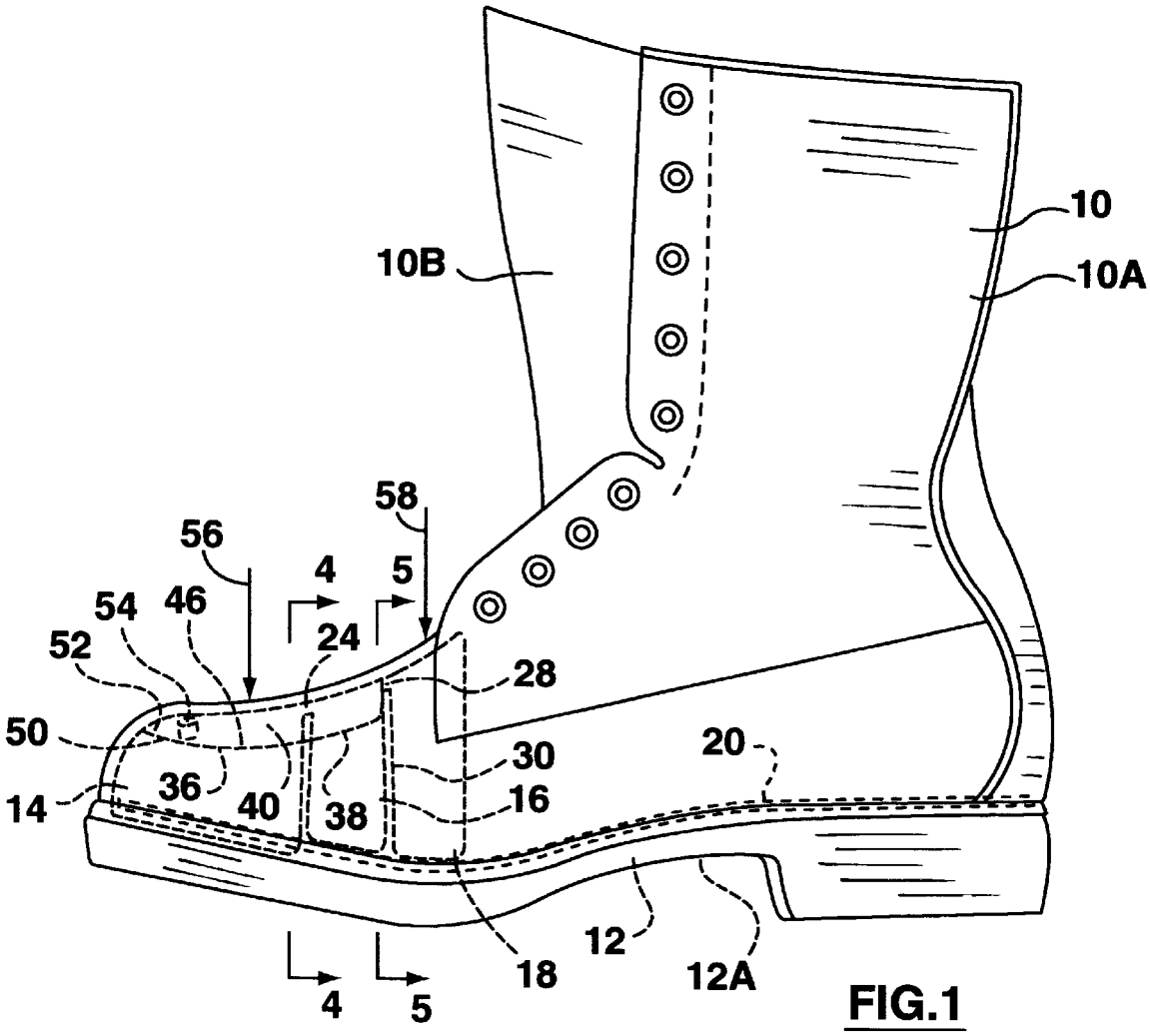
FIG. 1 is a side elevation of a safety boot having a combination toe and metatarsal protector of the invention incorporated therein, shown in broken lines.
Figure 2:
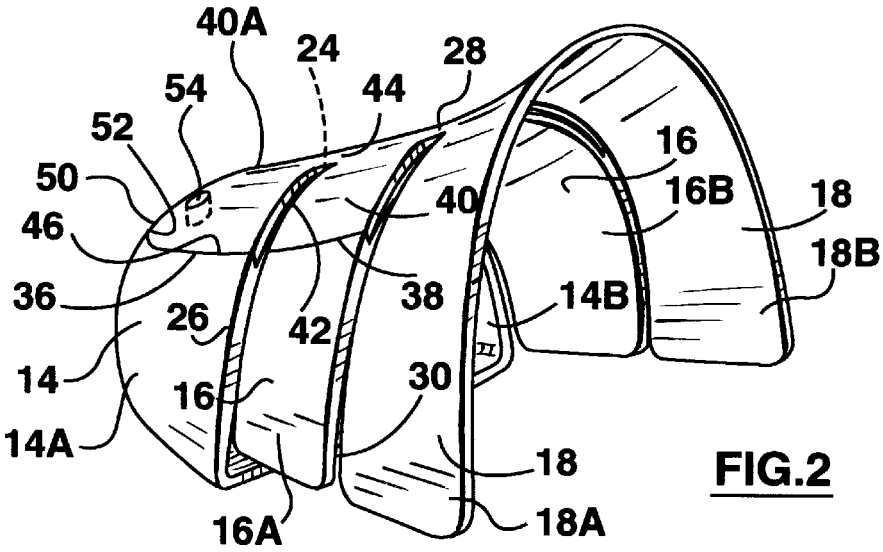
FIG. 2 is a perspective view of the combination protector from above and to one side.
Figure 3:
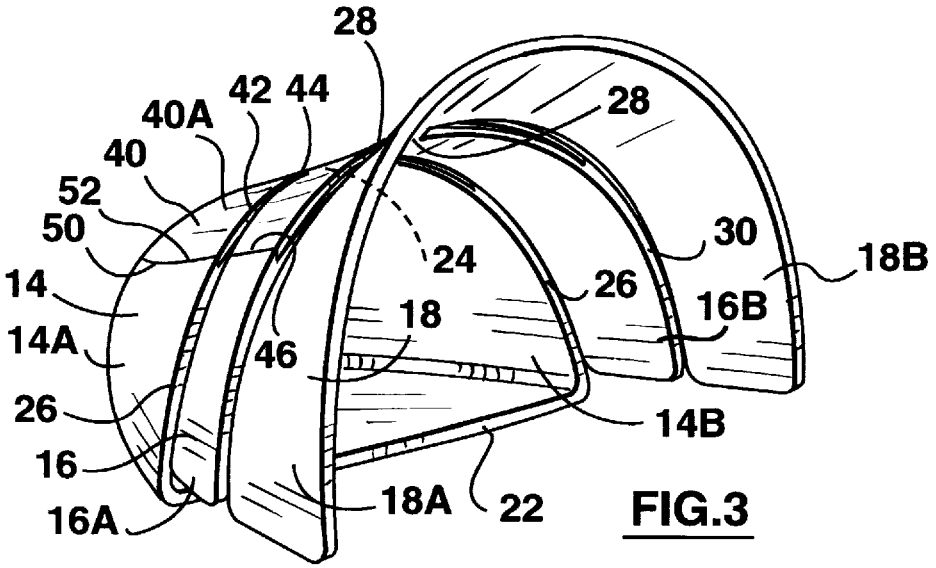
FIG. 3 is a perspective view of the combination protector from below and to one side.

Although for convenience the safety footwear shown in the drawings and described below is a safety boot, the invention is applicable equally to safety shoes, and both types of safety footwear are within the scope of the language of the claims. Footwear usually comprise an upper attached to a composite sole structure comprising as a minimum an insole and an outsole; other structural elements such as a midsole and, in the case of safety footwear a steel plate protecting against penetration by nails and similar sharp objects, may be interposed between the insole and outsole. For convenience in the language used in the claims any such composite sole structure is referred to simply as the footwear sole whatever its actual structure. For convenience the outer surface of an element is referenced using the same reference number as the element with the subscript A, while the corresponding inner surface reference employs the subscript B.

FIG. 1 shows in side elevation a safety boot comprising a typical boot upper 10 having respective outer and inner surfaces 10A and 10B, and an outsole 16 having respective outer and inner surfaces 12A and 12B, the upper and the outsole having respective toe regions that register with one another and metatarsal regions that register with one another. A combination toe and metatarsal protector of molded plastics material is incorporated into the boot between the inner surface 10B of the boot upper and the inner surface 12A of the outsole. In this embodiment the body of the combined protector is molded integrally in a single operation and comprises a toe part 14 between the two toe regions and a metatarsal part between the two metatarsal regions connected to the toe part, the metatarsal part comprising two connected portions of approximately equal size, namely a forward portion 16 and a rearward portion 18. An insole 20 lies against the inner surface 12A of the outsole and extends into the interior of the toe part. The boot may comprise other functional parts, such an inner lining for the upper, a midsole between the insole and outsole, and a metal or plastics material plate covering the instep to protect against penetration by spikes, but such other parts are not pertinent to the present invention and are not illustrated, the manner in which they may be incorporated into footwear being well known to those skilled in the art of footwear manufacture.

The toe protector part 14 comprises a generally U-shaped body having a top portion constituting the base of the U and two approximately parallel side portions constituting the sides of the U, the part therefore having an outer surface 14A that is convex toward inner surface 10B of the boot upper and an inner surface 14B that is concave toward the inner surface 12B of the outsole. In this embodiment the toe protector side portions have their free ends immediately adjacent to the outsole inner surface 12B and the two free ends are connected together by an integrally molded bottom portion 22 that butts against the outsole inner surface, the corresponding part of the insole 20 resting on the inner surface of the bottom portion. Thus, impact or crushing forces applied to the toe protector top portion are, as with the prior art steel box toe protectors, transmitted through the protector body to the boot outsole 12 and thus to the ground. A toe protector structure with an integral bottom portion is preferred when it is intended to meet the maximum specification for safety footwear, since it provides maximum resistance to spreading apart of the side portion free ends under the downward acting forces to which it is subjected. However, with footwear required to meet a lower specification it may be possible to eliminate the bottom portion to give a protector which is lighter, less expensive, and of lower height in side profile; in such a structure the side portion free ends will usually extend into contact with the outsole inner surface 12B so that the downward acting forces are transmitted directly to the outsole.

In this embodiment the integrally molded toe and metatarsal protector parts are joined together by a relatively flexible narrow central connecting portion 24 that remains when two arcuate slots 26 are formed during the molding operation, or alternatively formed by sawing through the molded part. The metatarsal protector part is itself divided longitudinally in the same manner into its two approximately equal parts by a narrow central connecting portion 28 that remains from the formation of two arcuate slots 30 extending from the central portion, these slots also being formed either during the molding operation, or by sawing through the molded part. The relatively flexible connecting portion 28 permits longitudinal flexing of the protector to conform to the flexing of the boot under the action of walking. The two parts of the metatarsal protector therefore each comprise a generally U-shaped body having respective top portions forming a base of the respective U and two side portions forming respective sides of the U, each protector part also having a respective outer surface 16A or 18A convex toward the inner surface 10B of the boot upper and a respective inner surface 16B or 18B concave toward the inner surface 12B of the boot outsole. The free ends of the side portions extend downwards at least sufficiently to engage the inner surface of the insole 20, and perhaps to engage the inner surface 12B of the outsole if the insole is sufficiently narrow at this location; it usually is not necessary, or even feasible, to connect the free ends together as with the toe protector.

In this embodiment the top portion of the toe protector part 14 and the top portion of the forward metatarsal protector part 16 are each provided at its respective outer surface with a respective depression 32 and 34 molded into the upper surface, each depression being shaped to provide two respective mutually facing, transversely spaced, longitudinally extending side surfaces 36 and 38 which respectively bound between themselves a central part of the respective top portion outer surface, these side surfaces extending outward from their central parts toward the inner surface 10B of the boot upper. No corresponding depression is provided in the rearward metatarsal protector part 18, as will be explained below. Since in this embodiment the toe and metatarsal protectors are connected, the resultant combined protector is provided with a single curved force receiving plate member 40 divided longitudinally into two connected parts by arcuate slots 42 leaving a narrow central relatively flexible connection 44 between them. The combined protector thus constitutes a toe protector plate member part overlying the toe protector top portion outer surface 14A and a metatarsal protector plate member part overlying the outer surface 16A of the top portion of the forward metatarsal protector part. Each plate member part overlies, and is of concave shape toward, the respective central part of the toe protector part top portion outer surface 14A and the metatarsal protector part top portion outer surface 16A. Each plate member part has respective upper and lower surfaces 40A and 40B and further has two transversely spaced longitudinally extending side edges 46, which in this embodiment are engaged respectively with the two side surfaces 36 and 38 of the respective protector body part. The lower surfaces 40B of the plate member parts are spaced from the respective central parts so as to leave an arcuate air space 48 between them. In this embodiment the side surfaces 36 of the toe protector body part and the side edges 46 of the corresponding plate member part are joined at their ends nearer to the toe end by an end surface 50 and an end edge 52 respectively to form respective continuous surfaces and edges that are generally U-shaped in plan from above. Also in this embodiment, to facilitate assembly of the protector into the boot the force receiving plate member is retained by outwardly extending pins 54 on the toe protector body part, preferably of the same plastics material as the protector body and molded therewith, these pins serving also to connect the plate member to the forward metatarsal protector part, so that separate connecting means are not required. Alternatively the protector body and plate member can be held together for storage and assembly by adhesive, either applied as spots or lines at strategic locations or as a continuous line around the peripheries of the depression 32 and the plate member.

The usual application point for the toe impact and crushing tests is indicated in FIG. 1 by the arrow 56, while that for the metatarsal impact test is indicated by the arrow 58. The downward slope of the rearward metatarsal protector part 18 is sufficiently steep that heavy objects impacting thereon or crushing downward on the metatarsus are deflected downward onto the forward metatarsal protector part 16, and in particular onto the corresponding part of the plate member 40. Moreover, it is possible to make the rearward part somewhat thicker while maintaining a satisfactory side profile, so that it is better able to withstand the applied forces without need to provide a depression therein corresponding to depression 34 in the forward part and to extend the plate member to cooperate therewith. Any such crushing and impact forces applied to the plate member are operative to attempt to press the respective plate member part toward the respective central part in the direction to reduce the height of the arcuate air space 48 and to forcibly butt its side edges 46 against the two cooperating side surfaces 36 and 38 with conversion of such crushing and impact forces to corresponding butting forces distributed principally along the side surfaces and to a lesser extent along the end surface 50. These butting forces are in turn converted at least to some extent to compression forces applied to the sides of the body which act as columns to withstand them, so that the impact and compression forces applied to the centre portion of the relatively unsupported arch are directed to the portions of the body more able to withstand them. Moreover, the structure permits advantage to be taken of the somewhat higher modulus generally available in compression for these materials. It has been found that the provision of such an edge-engaging force receiving plate makes it possible to reduce substantially the overall thickness of the upper portions of the protectors required to enable them to meet the test requirements, so that the height of their side profiles can be kept within limits such that they can successfully be incorporated into a safety shoe or boot without making the shoe or boot appear unacceptably bulky, and with the possibility that existing boot-manufacturing molds, as used with the prior-used steel toe boxes, can also be used with the plastics material protectors of the invention.

Figure 4:
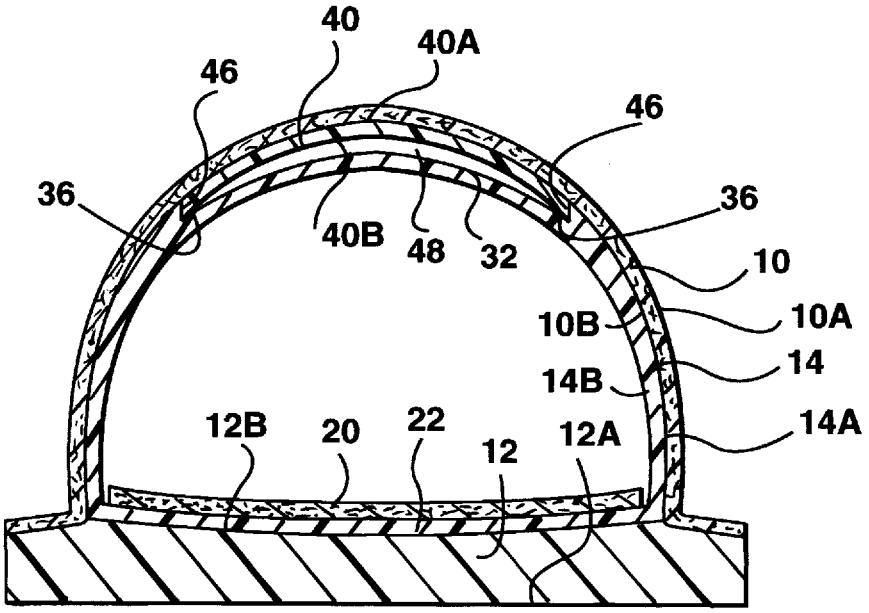
FIG. 4 is a cross-section through the toe protector part taken on the line 4—4 in FIG. 2.
Figure 5:
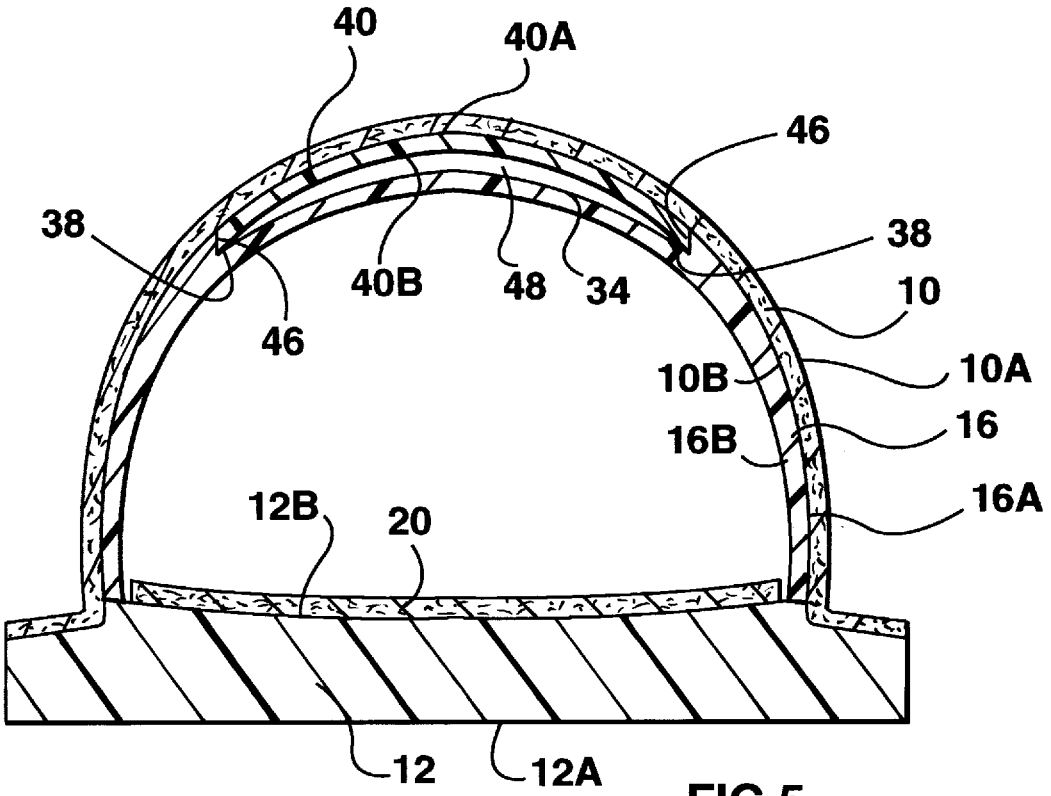
FIG. 5 is a cross-section through the metatarsal protector part taken on the line 5—5 in FIG. 2.
Figure 6:
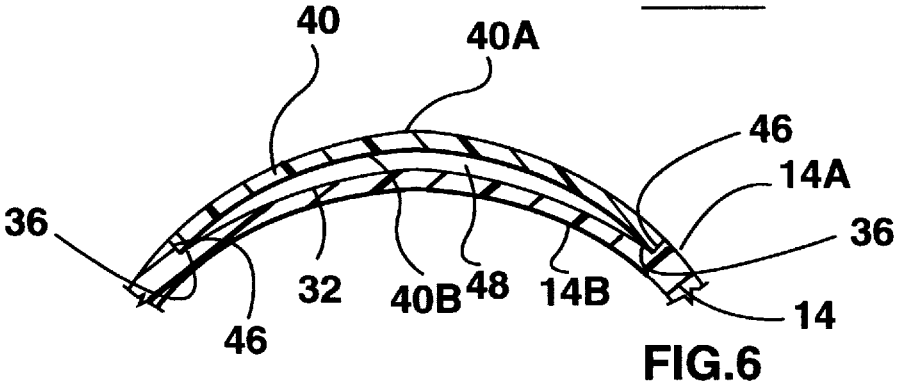
FIGS. 6 and 7 are cross-sections similar to FIG. 4 of two additional embodiments of the invention.

As will be seen from FIGS. 4 and 5, the surfaces 36 and 38 are inclined inward toward one another as they protrude from the central part of the upper surface of the top portion of the respective protector body part, so that the resultant corners are less than a right angle, and the edges of the plate members parts are correspondingly chamfered to the same angle, so that as the downward acting forces increase the edges of the plate member parts are wedged even more firmly into the corners. Instead, to facilitate the molding operation and to simplify the production of the force receiving plate, the surfaces may protrude perpendicularly from the central parts of the respective upper surface of the top portions of the protector body parts, as shown for example in FIG. 6, and chamfering of the plate part edges is not required.

In this embodiment the plate member edges engage two transversely spaced longitudinally extending surfaces and a connecting end surface of the toe protector part body, and two transversely spaced longitudinally extending surfaces of the metatarsal protector part body. In other embodiments not specifically illustrated the plate member edges may, particularly with one which is solely a toe protector, instead engage two longitudinally spaced transversely extending surfaces of the body, or the plate member may have both its longitudinally extending edges and its transversely extending edges engageable with cooperating surfaces of the protector body, the plate member having a generally domed shape; in such embodiments it will be usually be necessary to provide separate plate members for the toe protector and the parts of the metatarsal protector.

Figure 7:
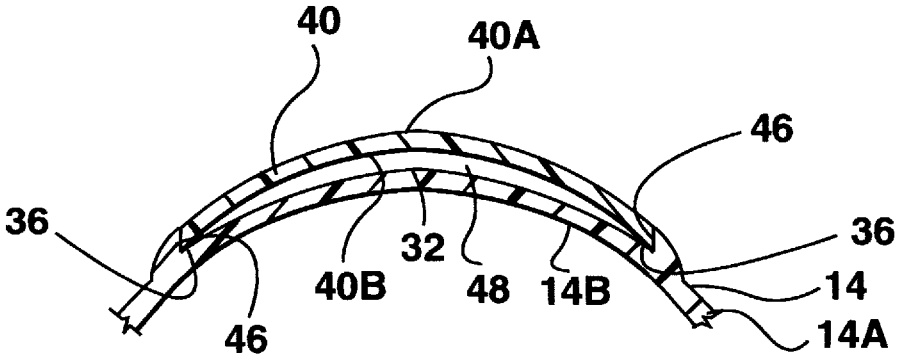

In the embodiments so far described the surfaces 36 and 38 are provided by forming corresponding depressions in the central portions of the protector bodies, but instead a structure such as is illustrated by FIG. 7 can be used in which the side surfaces are provided by outward extending ridges molded into the upper surfaces of the protector body parts.

The resistance of either protector part to the impact and crushing forces is of course adjusted by adjustment of the thickness of different parts of the respective body. In the protectors of the invention the resistance is also determined by the thickness of the plate member, and further by its effective radius of curvature, as compared to the radius of curvature of the body part top portion, a smaller radius resulting in a higher arcuate air space 48 and a corresponding increase in resistance. Although in the embodiments illustrated the plate member edges 46 and 52 are butted against the corresponding side and end surfaces 36, 38 and 50, in other embodiments a small clearance may be provided between the edges and surfaces so that some flattening of the plate member takes place before the edges and surfaces engage. The plate member can be of molded plastics material or of sheet steel, since such a simple component can be produced relatively inexpensively by stamping. Although in the embodiments described above only the forward part of the metatarsal protector is provided with a force receiving plate part, in other embodiments both parts can be so provided, the two parts being flexibly connected so that they can flex with the remainder of the protector.

Figure 8:
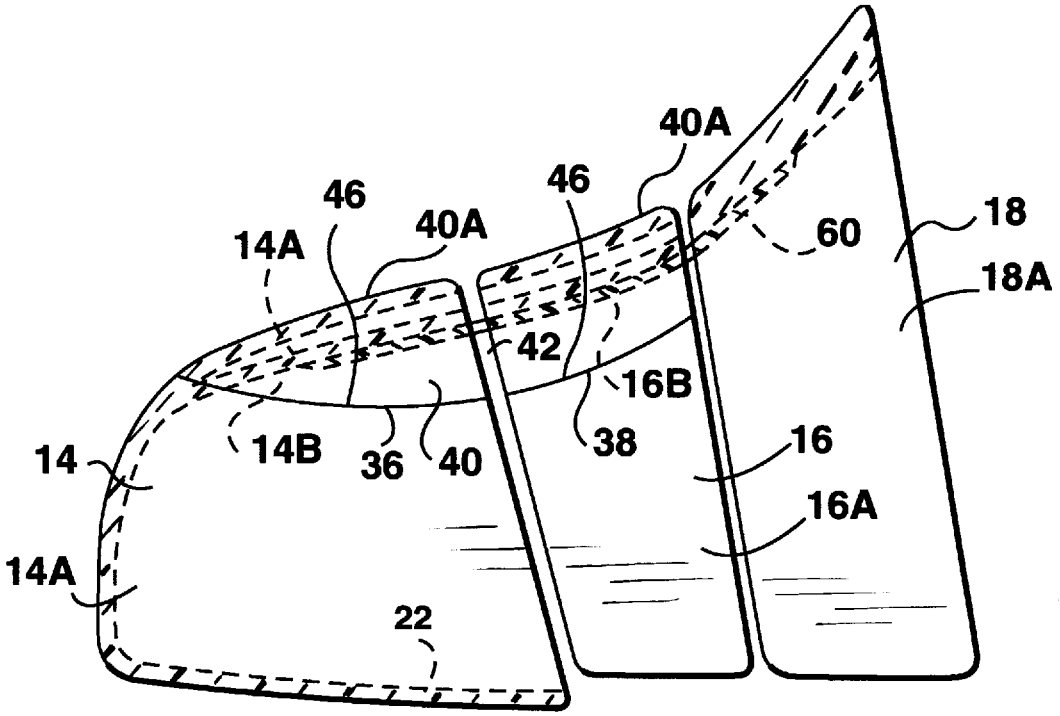
FIG. 8 is a perspective view of a combination toe and metatarsal protector showing a different manner of holding together the toe protector part and the metatarsal protector part to facilitate its incorporation into safety footwear.

Although a combined toe and metatarsal protector has been illustrated, it will be apparent that the invention is equally applicable to a separate toe protector and a separate metatarsal connector. The toe protector will usually not require longitudinal flexibility, and therefore will not be divided, while the metatarsal protector will usually require such flexibility, and can be made with more than two connected parts, especially in footwear and shoes of the larger sizes. FIG. 8 shows an alternative construction for a combined toe and metatarsal protector in which the separate parts are connected together by a strip 60 of highly flexible material, such as a synthetic fabric, glued or cemented to the corresponding surfaces, the use of such a strip permitting the use of plastics materials for the protector bodies that would otherwise be too stiff or brittle to form the needed flexible connecting portions 28 and 44.

Figure 9:
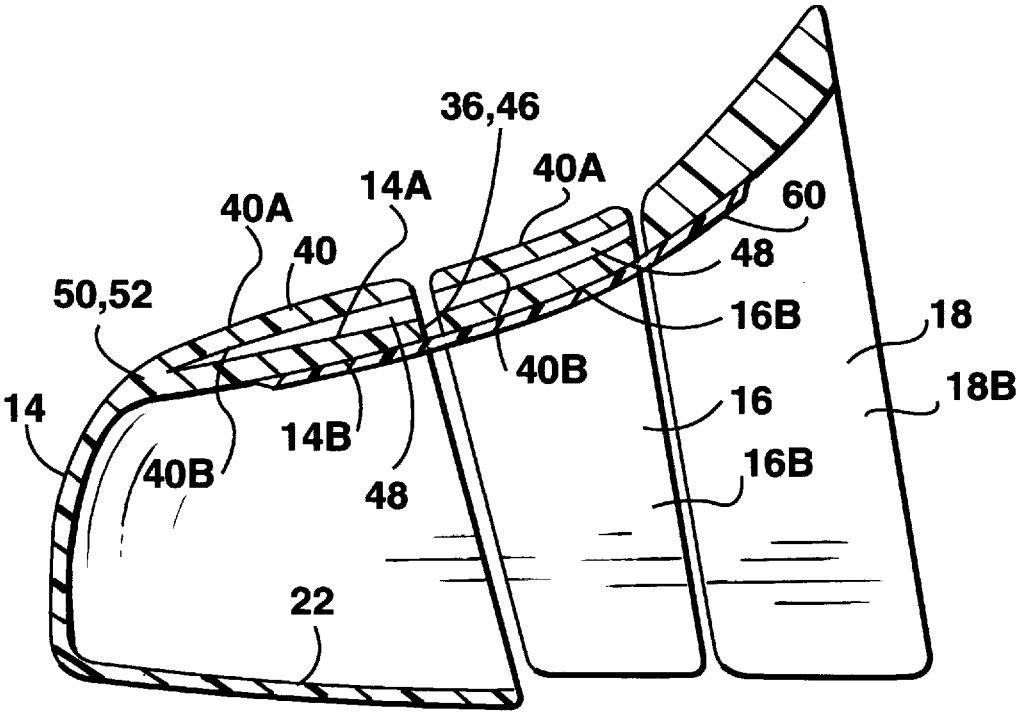
FIG. 9 is a longitudinal cross section through a combination toe and metatarsal protector in which the protector body parts and force receiving plate parts are integrally molded with one another.

In all the embodiments described above the protector body parts and the plate member are formed separately and then combined for incorporation in the footwear, and this does have the advantage that different materials can be used for the two major components, making maximum use of the different mechanical properties usually available with different materials. It is also possible to use the same materials for the two components, and in such case it becomes possible to mould them integrally with one another, the lines of engagement of the protector body side surfaces 36, 38 and 50 with the plate member side edges 46 and 52 being constituted by corresponding junctions in the integrally formed body. An example of such a structure is shown in FIG. 9. In commercial practice a number of molds are required to produce the range of sizes of footwear that must be available, and the molds required for manufacture of any integral embodiment will generally be more complex, and therefore more expensive, than those required when the components are separate, owing to the need to employ a retractable tongue, or similar device, to form the arcuate spaces 48, which would otherwise become filled with the molding material. A mold to form a toe protector alone, or a metatarsal protector alone, is of course much simpler in construction, and the molds can therefore be simplified considerably by making use of a structure such as is illustrated by FIG. 8, in which the three parts are molded separately and then attached to one another for storage and installation by a flexible strip connection 60, and such a structure is shown in FIG. 9.

With the use of the invention there is a wide range of moldable materials that can be used in the production of the protectors, such as high density polyethylene, glass fiber filled polyethylene, high density polypropylene, glass fiber filled polypropylene, polyurethanes, polycarbonates such as that sold under the trade mark "NERLON", ABS resins and ABS/polycarbonate composites, glass fiber filled ABS resins, polyesters such as those sold under the trade marks "HYTREL" and "RYNITE", nylons sold under the trade mark "ZYTEL" as Nylon 66, Modified Nylon 66, S1 Supertough Nylon 66, and Nylon 612, all of which may be reinforced with glass or carbon fiber. As with any commercial product, and particularly one that is so price sensitive as explained above, there are a number of factors that must be balanced in making the choice, including the cost of the chosen material and of its fabrication, and the width and height that can be tolerated in the final product.

In a particular preferred embodiment employing a glass fiber filled polyester as the plastics material from which the body of the protector is molded the overall thickness of the side and top portions of the body of the toe protector 14 is 3.125 mm (0.125 in), increasing to 4.7 mm (0.1875 in) in the neighbourhood of the side and end surfaces 36 and 50 so that this overall thickness is maintained at the location of the depression 32, while the thickness of the bottom portion is 1.56 mm (0.0625 in). The vertical height of the side and end surfaces 36 and 50 is also 1.56 mm (0.0625 in), while the thickness of the plate member, which is of uniform thickness, is the same so that its edges that butt the surfaces 36 and 50 are also of the same dimension. The plate member is of a polycarbonate resin and its curvature relative to that of the toe protector body top portion that it covers is such that at its centre the arcuate air space 48 is 1.25 mm (0.050 in) in height. Increase of this air space dimension will increase the resistance of the protector to the applied forces but with an increase in the profile height of the protector; the specific value will therefore depend upon the size of the shoe or boot, the material from which the protector has been made, and the level of the certification that is required.

The dimensions of the body part and plate member part for the metatarsal protector forward part 16 are the same as for the toe protector, while the thickness of the metatarsal protector rearward part top portion is somewhat thicker, namely 4.375 mm (0.175 in), the rear arcuate edge of the rearward part being tapered so that the protector will merge smoothly with the shoe and boot layers between which it is incorporated.

I claim:

1. A toe protector for safety footwear that comprise an upper and a sole joined to one another, the upper and sole each having respective outer and inner surfaces and having respective registering toe regions;

wherein the toe protector comprises a generally U-shaped body molded from plastics material, having a top portion constituting a base of the U and two side portions constituting respective sides of the U;

wherein the toe protector when incorporated into safety footwear is interposed between the upper and sole toe regions, and when so interposed has an outer surface convex toward the inner surface of the upper and an inner surface concave toward the inner surface of the sole;

wherein the toe protector body is provided at its top portion outer surface with two mutually facing, spaced surfaces extending outward from the outer surface toward the inner surface of the upper, the surfaces bounding between them a central part of the top portion outer surface;

wherein the toe protector also comprises a force receiving plate member having respective upper and lower surfaces and overlying the central part of the top portion outer surface with its lower surface spaced from the said central part, the plate member being of concave shape toward the said central part and having two spaced edges engageable respectively with the two surfaces of the protector body;

whereby crushing and impact forces applied to the force receiving plate member are operative to attempt to press the plate member toward the said central part and to forcibly butt its edges against the two cooperating surfaces with conversion of such crushing and impact forces to corresponding butting forces distributed along the surfaces.

2. A toe protector as claimed in claim 1, wherein the two spaced surfaces of the protector body are transversely spaced longitudinally extending side surfaces and the two spaced edges of the force receiving plate member are corresponding transversely spaced longitudinally extending side edges.

3. A toe protector as claimed in claim 1, wherein the two side portions have free ends adjacent to the sole and the two free ends are connected by an integrally molded bottom portion that butts against the sole.

4. A toe protector as claimed in claim 2, wherein the side surfaces of the protector body and the side edges of the plate member are joined at their ends nearer to the toe end respectively by an end surface and an end edge to form respective continuous surfaces and edges that are generally U-shaped in plan.

5. A toe protector as claimed in claim 1, wherein the surfaces of the protector body protrude perpendicularly from the central part of the protector body top portion upper surface.

6. A toe protector as claimed in claim 1, wherein the surfaces of the protector body are inclined inward toward one another as they protrude from the central part of the protector body top portion upper surface.

7. A toe protector as claimed in claim 1, wherein the surfaces are provided by a depression molded into the upper surface of the protector body.

8. A toe protector as claimed in claim 1, wherein the surfaces are provided by outward extending ridges molded into the upper surface of the protector body.

9. A toe protector as claimed in claim 1, wherein the force receiving plate member comprises a thin molded sheet of plastics material.

10. A toe protector as claimed in claim 1, wherein the protector body and the force receiving plate member are molded integrally with one another and the two spaced edges of the plate member engageable respectively with the two surfaces of the protector body are constituted by respective integral junctions of the protector body.

11. A toe protector as claimed in claim 1, wherein the force receiving plate member comprises a thin formed sheet of metal.

12. A toe protector as claimed in claim 1, wherein the force receiving plate member is secured by pins to the protector body.

13. A metatarsal protector for safety footwear that comprise an upper and a sole joined to one another, the upper and sole each having respective outer and inner surfaces and having respective registering metatarsal regions;

wherein the metatarsal protector comprises a generally U-shaped body molded from plastics material, having a top portion constituting a base of the U and two side portions constituting sides of the U;

wherein the metatarsal protector when incorporated into safety footwear is interposed between the metatarsal regions, and when so interposed has an outer surface convex toward the inner surface of the upper and an inner surface concave toward the inner surface of the sole;

wherein the protector body is provided at its top portion outer surface with two mutually facing spaced surfaces extending outward from the outer surface toward the inner surface of the upper, the side surfaces bounding between them a central part of the top portion outer surface; and wherein the metatarsal protector also comprises a force receiving plate member having respective upper and lower surfaces overlying the said central part of the top portion outer surface with its lower surface spaced from the said central part, the plate member being of concave shape toward the said central part and having two spaced edges engageable respectively with the two surfaces of the protector body;

whereby crushing and impact forces applied to the plate member are operative to attempt to press the plate member toward the said central part and to forcibly butt its edges against the two cooperating surfaces with conversion of such crushing and impact forces to corresponding butting forces distributed along the surfaces.

14. A metatarsal protector as claimed in claim 13, wherein the two spaced surfaces of the protector body are transversely spaced longitudinally extending side surfaces and the two spaced edges of the force receiving plate member are corresponding transversely spaced longitudinally extending side edges.

15. A metatarsal protector as claimed in claim 13, wherein the surfaces of the protector body protrude perpendicularly from the central part of the protector body top portion upper surface.

16. A metatarsal protector as claimed in claim 13, wherein the surfaces of the protector body are inclined inward toward one another as they protrude from the central part of the protector body top portion upper surface.

17. A metatarsal protector as claimed in claim 13, wherein the surfaces are provided by a depression molded into the upper surface of the protector body.

18. A metatarsal protector as claimed in claim 13, wherein the surfaces are provided by outward extending ridges molded into the upper surface of the protector body.

19. A metatarsal protector as claimed in claim 13, wherein the force receiving plate member comprises a thin molded sheet of plastics material.

20. A metatarsal protector as claimed in claim 13, wherein the protector body and the force receiving plate member are molded integrally with one another and the two spaced edges of the plate member engageable respectively with the two surfaces of the protector body are constituted by respective integral junctions of the protector body.

21. A metatarsal protector as claimed in claim 13, wherein the force receiving plate member comprises a thin formed sheet of metal.

22. A metatarsal protector as claimed in claim 13, wherein the force receiving plate member is secured by pins to the protector body.

23. A metatarsal protector as claimed in claim 13, wherein the protector body and the force receiving plate member are each divided along its length by respective transversely extending slots to increase the longitudinal flexibility of the protector and facilitate corresponding flexing of footwear in which it is incorporated under the action of walking.

24. A combined toe and metatarsal protector for safety footwear that comprise an upper and a sole joined to one another, the upper and sole each having respective outer and inner surfaces and having respective registering toe and metatarsal regions;

wherein the combined protector comprises a toe protector part and a metatarsal protector part molded from plastics material attached to one another, each of said parts comprising a generally U-shaped body having a top portion constituting a base of the U and two side portions constituting sides of the U;

the toe and metatarsal protector when incorporated into safety footwear being interposed between the toe and metatarsal regions, and when so interposed each having an outer surface convex toward the inner surface of the upper and an inner surface concave toward the inner surface of the sole;

wherein the toe and metatarsal protector parts are each provided at its respective top portion outer surface with two mutually facing, spaced surfaces extending outward from the respective outer surface toward the lower surface of the upper, each two cooperating surfaces bounding between them a respective central part of the respective top portion outer surface; and wherein the toe and metatarsal protector also comprises for each of its parts a respective force receiving plate member part having respective upper and lower surfaces and overlying the respective central part of the respective top portion outer surface with its respective lower surface spaced from the respective central part, each plate member part being of concave shape toward the respective central part and having two spaced edges engageable respectively with the two surfaces of the respective protector body part;

whereby crushing and impact forces applied to each plate member part are operative to attempt to press the plate member part toward the respective central part and to forcibly butt its edges against the two cooperating surfaces with conversion of such crushing and impact forces to corresponding butting forces distributed along the surfaces.

25. A toe and metatarsal protector as claimed in claim 24, wherein the two spaced surfaces of each protector body part are transversely spaced longitudinally extending side surfaces and the two spaced edges of each force receiving plate member part are corresponding transversely spaced longitudinally extending side edges.

26. A toe and metatarsal protector as claimed in claim 25, wherein the side surfaces of the toe protector body part and the side edges of the respective plate member part are joined at their ends nearer to the toe end respectively by an end surface and an end edge to form respective continuous surfaces and edges that are generally U-shaped in plan.

27. A toe and metatarsal protector as claimed in claim 24, wherein the two side portions of the toe protector part have free ends adjacent to the sole and the two free ends are connected by an integrally molded bottom portion that butts against the sole.

28. A toe and metatarsal protector as claimed in claim 24, wherein the surfaces of the protector body parts protrude perpendicularly from the central part of the respective protector body top portion upper surface.

29. A toe and metatarsal protector as claimed in claim 24, wherein the surfaces of the protector body parts are inclined inward toward one another as they protrude from the central part of the respective protector body top portion upper surface.

30. A toe and metatarsal protector as claimed in claim 24, wherein the surfaces are provided by a depression molded into the upper surface of the respective protector body part.

31. A toe and metatarsal protector as claimed in claim 24, wherein the surfaces are provided by outward extending ridges molded into the upper surface of the respective protector body part.

32. A toe and metatarsal protector as claimed in claim 24, wherein the force receiving plate member comprises a thin molded sheet of plastics material.

33. A toe and metatarsal protector as claimed in claim 24, wherein each protector body part and the corresponding force receiving plate member part are molded integrally with one another and the two spaced edges of the plate member part engageable respectively with the two surfaces of the protector body part are constituted by respective integral junctions of the protector body part.

34. A toe and metatarsal protector as claimed in claim 24, wherein the force receiving plate member comprises a thin formed sheet of metal.

35. A toe and metatarsal protector as claimed in claim 24, wherein the force receiving plate member is secured by pins to the toe protector body part.

36. A toe and metatarsal protector as claimed in claim 24, wherein the protector body part and the force receiving plate member are each divided along its length by respective transversely extending slots to increase the longitudinal flexibility of the protector and facilitate corresponding flexing of footwear in which it is incorporated under the action of walking.

37. A toe and metatarsal protector as claimed in claim 24, wherein the toe protector body part and the metatarsal protector body part are connected together by a longitudinally extending thin piece of flexible material to increase the longitudinal flexibility of the protector and facilitate corresponding flexing of footwear in which it is incorporated under the action of walking.

* * * * *